US005503872A

United States Patent [19]

MacKenzie et al.

[11] Patent Number: 5,503,872

[45] Date of Patent: Apr. 2, 1996

[54] FLAMELESS PLASTIC COATING APPARATUS AND METHOD THEREFOR

[76] Inventors: Kenneth R. MacKenzie, 606, 718-12th Avenue SW, Calgary, Alberta, Canada; Randy E. Gosselin, 5076 S. Kings Ranch Rd., Gold Canyon, Ariz. 85219

[21] Appl. No.: 209,917

[22] Filed: Mar. 14, 1994

[51] Int. Cl.[6] ..... B05C 5/04; B05B 1/24; B05D 3/00

[52] U.S. Cl. ..... 427/195; 427/422; 239/13; 239/79; 239/85; 239/135

[58] Field of Search ..... 239/79–85, 133, 239/135, 8, 13; 427/195, 447, 422

[56] References Cited

U.S. PATENT DOCUMENTS

| | | | |
|---|---|---|---|
| 3,958,758 | 5/1976 | Piorkowski | 239/133 |
| 4,049,842 | 9/1977 | Gerek et al. | 427/447 |
| 4,065,057 | 12/1977 | Durmann | 239/135 |
| 4,183,974 | 1/1980 | Coucher et al. | 427/195 |
| 4,289,807 | 9/1981 | Christensen et al. | 427/195 |
| 5,302,414 | 4/1994 | Alkhimov et al. | 427/195 |

FOREIGN PATENT DOCUMENTS

| | | | |
|---|---|---|---|
| 87/00452 | 1/1987 | WIPO | 239/85 |

*Primary Examiner*—Karen B. Merritt
*Attorney, Agent, or Firm*—Harry M. Weiss; Jeffrey D. Moy; Harry M. Weiss & Associates

[57] ABSTRACT

A stream of hot air passes from a combustion chamber through an application gun to a preheated substrate. A powdered thermoplastic is fed into the application gun. The hot air stream heats the powdered thermoplastic to its fusion temperature and transports it to the substrate.

24 Claims, 2 Drawing Sheets

FLAMELESS PLASTIC COATING APPARATUS AND METHOD THEREFOR

BACKGROUND OF THE INVENTION

1. Field of Invention

This invention is in the field of coating apparatus and methods therefor and, more particularly, is an apparatus for coating a substrate with a thermoplastic and method therefor.

2. Description of the Prior Art

A usual way of making a substrate impervious to harsh and corrosive environments is to coat it with a solvent based coating. A disadvantage of the solvent based coating is that the solvent includes a volatile organic compound that is a hazard to the health of people who handle it. Moreover, because of the inclusion of the organic compound, improper disposal of the solvent has a negative impact on the environment.

As an alternative to the solvent based coating, what is known as a flame spray process is used to coat the substrate with a polymer, such as thermoplastic. In the flame spray process, a flame is applied to a powdered thermoplastic at the mouth of an application gun that an operator points at the substrate. The flame fuses the thermoplastic. The fused thermoplastic is propelled by a stream of air from the mouth of the application gun to the substrate.

The temperature of the flame is on the order of 1800° F. plus. The temperature causes a pyrolysis of a significant amount of the thermoplastic. The pyrolysis may result in an emission of toxic gasses that are a hazard to the health of the operator. Additionally, the temperature may result in a change of the molecular structure of the thermoplastic, known as cross-linking, that renders the plastic relatively ineffective.

The partial pyrolysis additionally creates a brightly colored flame, thereby preventing the operator from viewing the substrate while it is being coated. The operator must either frequently move the flame or repeat the flame spray process when the substrate is not completely coated. Therefore, the partial pyrolysis reduces the application rate of the coating.

It should be understood that the colored flame erupts in an explosive blast from the mouth of the application gun, thereby causing turbulence near the flame. The turbulence causes an overspray that increases the amount of thermoplastic that is used. Additionally, when the substrate is comprised of aluminum, for example, heat from the colored flame may cause an undesired change in the substrate; such as warping.

Heretofore, there has not been a simple, safe, economic and efficient way of coating the substrate with the thermoplastic.

SUMMARY OF THE INVENTION

An object of the present invention is to provide an improved apparatus for coating a substrate with a thermoplastic and method therefor.

Another object of the present invention is to provide an improved apparatus for coating a substrate with a thermoplastic with a limited chance of causing pyrolysis and method therefor.

Another object of the present invention is to provide apparatus for heating a thermoplastic to a selected temperature in a stream of hot air and method therefor.

BRIEF DESCRIPTION OF THE PREFERRED EMBODIMENT

According to a first aspect of the present invention, a combustible gas and air are mixed in a combustion chamber in a selected ratio to form a combustible mixture that is continuously ignited. An expanding stream of hot air passes from the combustion chamber through an application gun to a substrate. Powdered thermoplastic is fed through a powder feed tube to the application gun. The hot air stream fuses the powdered thermoplastic and transports it to the substrate.

According to a second aspect of the present invention, the powder feed tube and application gun have double walls. Cooling air is forced between the walls.

The present invention obviates pyrolysis and limits potential of cross-linking. Moreover, apparatus according to the invention is economical, reliable and operable without having a negative impact on the environment.

Other objects, features and advantages of the present invention will be apparent from the following description of a preferred embodiment thereof and the accompanying drawing.

DESCRIPTION OF THE PREFERRED EMBODIMENT

Figure 1:
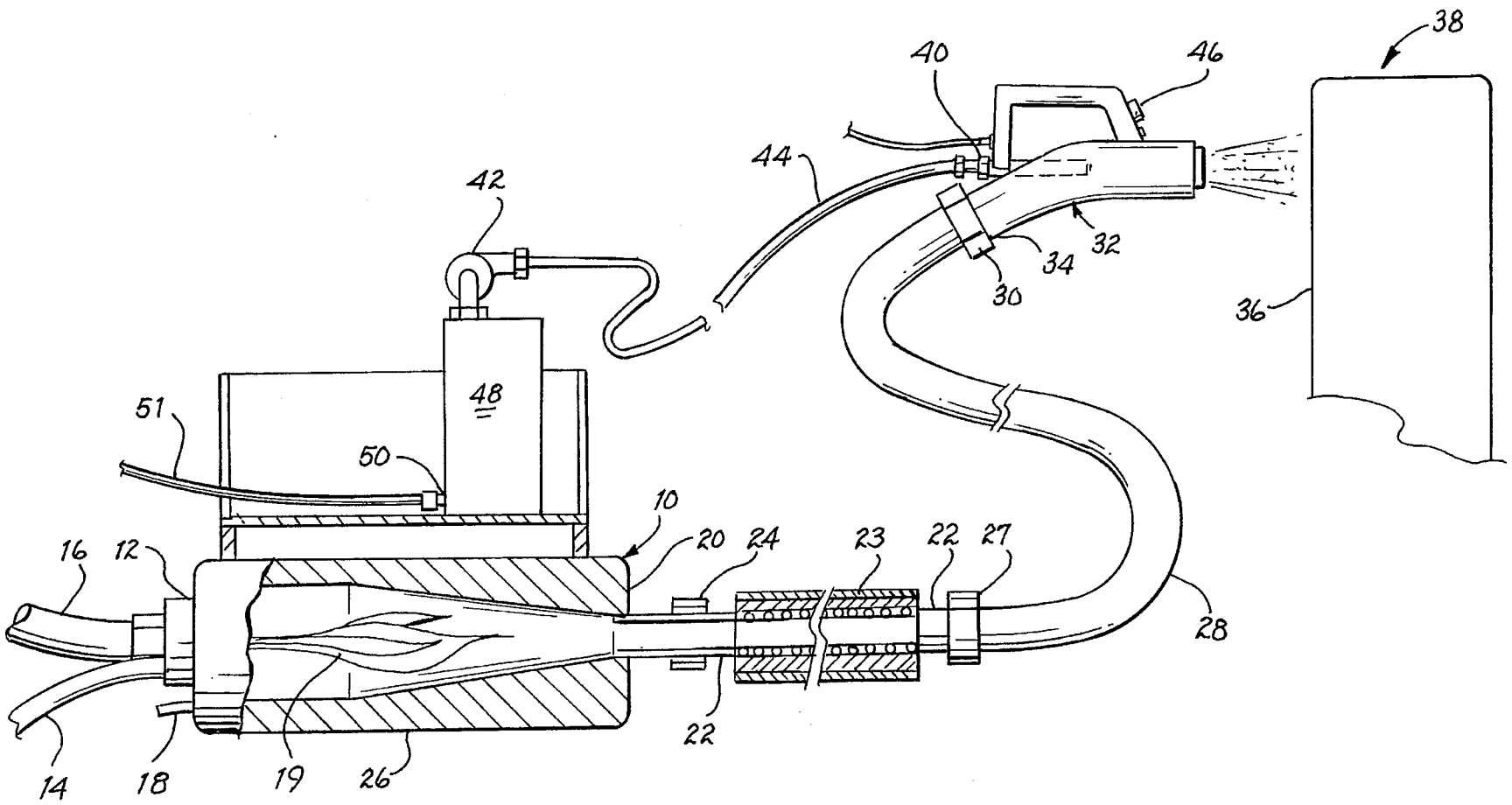
FIG. 1 is a side elevation, with parts broken away, of the preferred embodiment of the present invention.

As shown in FIG. 1, a combustion chamber 10 has an end wall 12 through which pipes 14, 16 extend. A source of propane gas (not shown) provides a flow of propane through pipe 14 into chamber 10. Correspondingly, a source of compressed air (not shown) provides a flow of air through pipe 16 into chamber 10. The air and the propane combine to form a combustible mixture. In an alternative embodiment, a combustible gas, other than propane, is used to form the combustible mixture.

A spark plug 18 extends through end wall 12 whereby contacts of spark plug 18 are within chamber 10. External to chamber 10, spark plug 18 is connected to a source of electrical power (not shown). Because of the connection to the electrical power source, a substantially continuous spark is provided between the contacts of spark plug 18. The spark causes a substantially continuous ignition of the combustible mixture, thereby providing a flame 19 within chamber 10. The use of a spark plug to provide a spark is well known in the art.

An end wall 20 of chamber 10 is connected to a hose 22 by a coupling 24. The ignition of the combustible mixture produces a chamber temperature that causes an expanding stream of hot air to flow into hose 22. A ceramic wool thermal insulation 23 covers hose 22 to reduce a heat loss that causes a reduction in the temperature of the hot air stream.

As explained hereinafter, the hot air stream is used to heat a powdered thermoplastic to a desired temperature that causes fusion of the powdered thermoplastic without causing pyrolysis. For almost all types of powdered thermoplastic, the desired temperature is produced when the chamber temperature is in a range of 1000° to 2500° Fahrenheit.

The chamber temperature is directly related to the ratio of propane to compressed air that flows through pipes 14, 16, respectively. Therefore, the chamber temperature is selectable. The top and sides of chamber 10 are covered with a ceramic wool thermal insulation 26 to reduce the heat loss that causes the reduction of the temperature of the stream of hot air.

Hose 22 is connected through a coupling 27 to the proximal end of a flexible end whip hose 28. The distal end of end whip hose 28 is connected through a coupling 30 to an application gun 32 at a hot air inlet port 34 thereof. As explained hereinafter, application gun 32 directs a thermoplastic laden stream of hot air to a surface 36 of a substrate 38.

In this embodiment, substrate 38 is of a size that makes movement of application gun 32 relative to substrate 38 necessary to completely coat surface 36. Hence, it is preferable that end whip hose 28 have greater ease of movement of its distal end than hose 22, for example. A layer of insulation (not shown) is provided within hose 28 that is sufficiently thin to facilitate the greater ease of movement.

Application gun 32 has a powdered thermoplastic inlet port 40 that is connected to a Venturi powder pump 42 through a powder hose 44. Pump 42 is connected through an air line (not shown) to a pilot valve 46 that is mounted upon application gun 32. Pump 42 is connected to a fluid bed 48. Pump 42 is used to pump powdered thermoplastic from fluid bed 48 through inlet port 40 in a manner explained hereinafter.

Fluid bed 48 has an air inlet 50 connected to a hose 51. Air is supplied to fluid bed 48 through inlet 50 via hose 51. In response to air being supplied through inlet 50, the stored powdered thermoplastic is suspended in the air within fluid bed 48. Venturi pumps and fluid beds are well known to those skilled in the art.

Pump 42 causes the stored powdered thermoplastic to be pumped from fluid bed 48 to inlet port 40 at a rate that is directly related to the flow of air through valve 46. In other words, valve 46 is manipulated to cause the powdered thermoplastic to be provided at a desired rate to inlet port 40.

Figure 2:
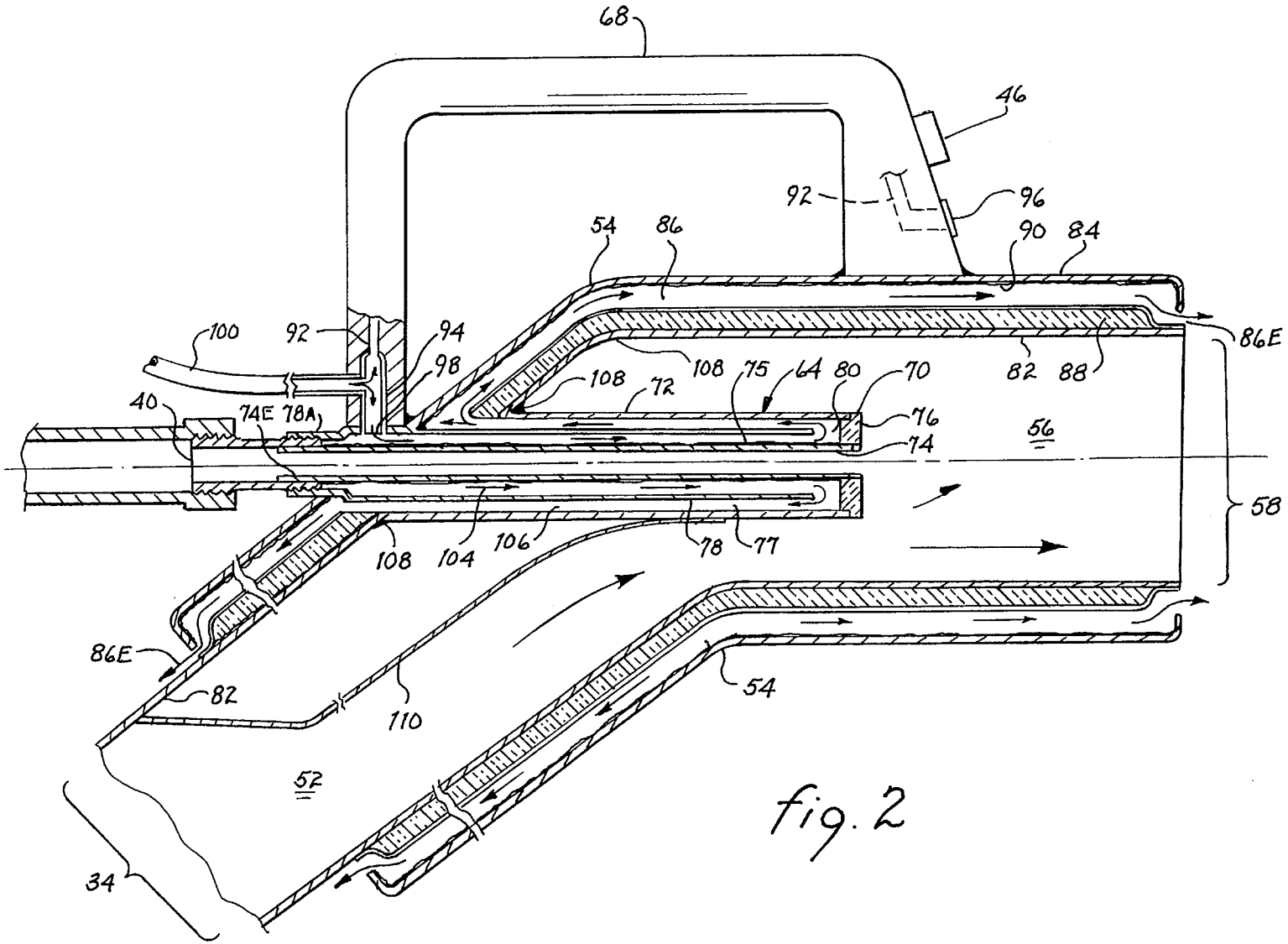
FIG. 2 is a side elevation, with parts broken away, of an application gun in the embodiment of FIG. 1.

As shown in FIG. 2, inlet port 34 is contiguous with a hot air passageway 52 that has a bend 54 at its distal end. A cylindrical barrel 56 of application gun 32 has one end that is contiguous with the distal end of passageway 52. The other end of barrel 56 forms a mouth 58 of application gun 32.

Inlet port 40 is connected to a generally cylindrical aluminum powder feed tube 64 that is coaxial to barrel 56. In an alternative embodiment, tube 64 and barrel 56 are not coaxial. Tube 64 is additionally connected to a handle 68 of application gun 32 in a manner described hereinafter.

A distal end 70 of tube 64 extends to the interior of barrel 56. Accordingly, tube 64 provides a passageway for the powdered thermoplastic from inlet port 40 to the interior of barrel 56. Because of the hot air stream, powdered thermoplastic within barrel 56 is fused and transported to surface 36, whereby surface 36 is coated.

When the chamber temperature is selected to be at a temperature within the chamber temperature range, the temperature of the hot air stream within barrel 56 is within a fusion temperature range of 850° to 2300° Fahrenheit. Almost all powdered thermoplastics are fused at a temperature within the fusion temperature range.

In this embodiment, substrate 38 is preheated to a temperature of 180° Fahrenheit. In an alternative embodiment, substrate 38 is preheated to a different temperature.

It should be understood that the hot air stream heats tube 64 and application gun 32. A fusing of the powdered thermoplastic within tube 64 is prevented by a cooling system which is described hereinafter.

The cooling system additionally cools application gun 32. The cooling of application gun 32 is desirable so that the operator can safely handle application gun 32 without a risk of being seriously burned.

The cooling system is predicated upon circulating cooling air between double walls of tube 64 and application gun 32. Additionally, the cooling air is circulated through handle 68.

Tube 64 is comprised of a cylindrical outer wall 72 and a cylindrical inner wall 74 that are coaxial. Within tube 64, walls 72, 74 carry ceramic wool thermal insulation 77, 75, respectively to thermally insulate the powdered thermoplastic that passes through tube 64 from the hot air stream.

An annular end seal 76 connects wall 72 to wall 74, thereby forming distal end 70 referred to hereinbefore. An end 74E of wall 74 is circumferentially connected to the inside of inlet port 40.

A cylindrical inner tube 78 is disposed between walls 72, 74 with an air passage space 80 between an end of tube 78 and end seal 76. Tube 78 and walls 72, 74 are coaxial. Tube 78 has a narrowed end section 78A that is circumferentially connected to the outside of inlet port 40. Adjacent the circumferential connection to inlet port 40, tube 78 is connected to handle 68. As explained hereinafter, tube 78 divides the space between walls 72, 74 into a pair of cylindrical passageways through which there is a flow of cooling air.

Passageway 52 and barrel 56 have a contiguous inner wall 82 and a contiguous outer wall 84 that form a passageway 86. Within passageway 86, walls 82, 84 carry ceramic wool thermal wool insulations 88, 90, respectively to thermally insulate outer wall 88 from the hot air stream.

Handle 68 has an air passageway 92 therein that extends from an air inlet port 94 to an air outlet port 96 in one direction and to a hole 98 through tube 78 in the opposite direction. Inlet port 94 is connected to a hose 100.

When a flow of cooling air is provided through inlet port 94 via hose 100, a first part of the cooling air passes through outlet port 96 via passageway 92, thereby cooling handle 68. A second part of the cooling air passes through hole 98 to a first cylindrical passageway 104 formed by tube 78 and wall 74, thereby cooling the interior of tube 64.

In a similar manner, tube 78 and wall 72 form a second cylindrical passageway 106. An end 108 of wall 72 is connected to wall 82, thereby connecting passageway 106 to passageway 86. Hence, the second part of the cooling air flows from passageway 104, through air passageways 106, 86 via air passage space 80 thereby cooling tube 64 and application gun 32. Ends of passageway 86 are connected to outlet ports 86E, whereby the cooling air passes from application gun 32. Preferably, the cooling system described hereinbefore cools the exterior of application gun 32 to a temperature of less than 150 degrees Fahrenheit.

Applicants have found that when the hot air stream flows through passageway 52, an outer bend region 108 of bend 54 becomes excessively heated. Preferably, an air diverter plate 110 is connected to wall 82 and tube 54. Plate 110 is positioned to divert the hot air stream away from region 108, thereby obviating the excessive heating.

While the invention has been described with reference to a preferred embodiment, it should be understood by those skilled in the art that changes in form and detail may be made therein without departing from the spirit and the scope of the invention.

We claim:

1. Apparatus for applying a thermoplastic coating to a substrate, comprising, in combination:

a substrate;

means for producing a stream of hot air that passes to said substrate, said hot air stream having a temperature intermediate to a fusion temperature of a powdered thermoplastic and a temperature that causes pyrolysis of said powdered thermoplastic; and means for causing said hot air stream to be laden with said fused powdered thermoplastic;

said means for producing comprising:

a combustion chamber adapted for connection to a source of compressed air and a source of a combustible gas, air in said chamber combining with said gas to form a combustible mixture; and means for continuously igniting said mixture within said chamber to produce said stream of hot air;

said means for causing comprising:

an application gun connected through a hose to said chamber, said hot air stream passing from said chamber to said application gun through said hose;

a thermoplastic powder inlet of said application gun that is connected to a source of said thermoplastic powder;

a powder feed tube that extends from said powder inlet to the interior of a barrel of said application gun; and means for pumping said thermoplastic powder from said source to the interior of said barrel.

2. The apparatus of claim 1 wherein said means for igniting includes a spark plug.

3. The apparatus of claim 1 wherein the temperature of said hot air stream within said chamber is within a range of 1000 to 2500 degrees Fahrenheit.

4. The apparatus of claim 1 wherein said combustible gas is propane and the temperature of said hot air stream is directly related to the ratio of said propane and said compressed air that flows into said chamber.

5. The apparatus of claim 1 wherein said powdered plastic source comprises a fluid bed wherein said powdered plastic is stored.

6. The apparatus of claim 1 wherein said pumping means comprises a Venturi powder pump.

7. The apparatus of claim 1 wherein said barrel is one of cylindrical and oval and said feed tube and said barrel are coaxial.

8. The apparatus of claim 1 wherein said feed tube and said application gun have double walls that are adapted for connection to a source of cooling air, said cooling air passing between said walls.

9. The apparatus of claim 8 wherein said source of said cooling air is connected to a passageway through a handle of said application gun, additionally comprising a cylindrical inner tube coaxially disposed between inner and outer walls of said feed tube to form a first passageway connected to said handle passageway and a second passageway connected to said first passageway and to a passageway formed by said double wall of said application gun.

10. The apparatus of claim 1 wherein said hose is a thermally insulated hose with one end connected to said chamber, additionally comprising a flexible end whip hose that connects the other end of said insulated hose to said application gun.

11. The apparatus of claim 1 wherein said application gun has a bend in a hot air passageway thereof, additionally comprising a diverting plate disposed within said hot air passageway that diverts said hot air stream from the outer radius of said bend.

12. The apparatus of claim 1 wherein said substrate is preheated to a temperature of approximately 180° Fahrenheit.

13. A process for applying a thermoplastic coating to a substrate comprising the steps of:

producing a stream of hot air that passes to said substrate, said hot air stream having a temperature intermediate to a fusion temperature of a powdered thermoplastic and a temperature that causes pyrolysis of said powdered thermoplastic; and causing said hot air stream to be laden with fused powdered thermoplastic;

said step of producing comprising the steps of:

providing a combustion chamber adapted for connection to a source of compressed air and a source of a combustible gas, air in said chamber combining with said gas to form a combustible mixture; and continuously igniting said mixture within said chamber to produce said stream of hot air;

said step of causing comprising the steps of:

providing an application gun connected through a hose to said chamber, said hot air stream passing from said chamber to said application gun through said hose;

connecting a thermoplastic powder inlet of said application gun to a source of said thermoplastic powder;

providing a powder feed tube that extends from said powder inlet to the interior of a barrel of said application gun; and pumping said thermoplastic powder from said source to the interior of said barrel.

14. In the process of claim 13 wherein the temperature of said hot air that fuses said powdered thermoplastic is in an approximate range of 850° to 2300° Fahrenheit.

15. In the process of claim 13 wherein said step of continuously igniting includes the step of igniting within said chamber to provide said hot air stream therein at a temperature within an approximate range of 1000° to 2500° Fahrenheit.

16. In the process of claim 13 the additional step of preheating said substrate.

17. In the process of claim 16 wherein the step of preheating includes the step of preheating to approximately 180° Fahrenheit.

18. In the process of claim 13 wherein said powdered thermoplastic is provided through said powder feeder tube that extends to the interior of said application gun where said powdered thermoplastic is fused by said hot air stream, the additional step of maintaining the exterior of said application gun at a temperature of less than approximately 150° Fahrenheit.

19. Apparatus for applying a thermoplastic coating to a substrate, comprising, in combination:

mixing means for mixing a fuel with compressed air to form a combustible gaseous mixture;

igniting means, coupled to said mixing means, for igniting said combustible gaseous mixture to produce a hot air stream, said hot air stream having a temperature intermediate to a fusion temperature of a powdered thermoplastic and a temperature that causes pyrolysis of said powdered thermoplastic;

ladening means, remote from yet coupled to said mixing means and said igniting means, for causing said hot air stream to be laden with said powdered thermoplastic; and portable applying means, enclosing said ladening means, for directing said hot air stream laden with said powdered thermoplastic to said substrate.

20. The apparatus of claim 19 wherein said mixing means for forming said combustible gaseous mixture comprises, in combination:

a combustion chamber;

a first inlet port to said combustion chamber for said fuel; and a second inlet port to said combustion chamber for said compressed air.

21. The apparatus of claim 19 wherein said igniting means includes a spark plug.

22. The apparatus of claim 19 wherein said ladening means comprises, in combination:

a first inlet port for said hot air stream;

a second inlet port for said powdered thermoplastic material, means for mixing said hot air stream with said powdered thermoplastic material to produce a hot air stream laden with powdered thermoplastic; and means for regulating the flow rate of said powdered thermoplastic material at said second inlet port.

23. The apparatus of claim 19 wherein said portable applying means includes an application gun comprising, in combination:

a handle member for manual application of said hot air stream laden with said powdered thermoplastic to said substrate;

a barrel to control the direction of said hot air stream laden with said powdered thermoplastic; and means coupled to said application gun for cooling portions of said application gun to facilitate manual application of said hot air stream laden with said powdered thermoplastic to said substrate and to prevent risk of injury to a user of said apparatus.

24. The apparatus of claim 19 further including means for coupling said mixing and igniting means with said ladening and applying means comprising a flexible hose covered by a ceramic wool thermal insulation material to prevent heat loss from said hot air stream.

* * * * *